US008568654B2

(12) United States Patent
La Sorda

(10) Patent No.: US 8,568,654 B2
(45) **Date of Patent: *Oct. 29, 2013**

(54) VAPOR-REINFORCED EXPANDING VOLUME OF GAS TO MINIMIZE THE CONTAMINATION OF PRODUCTS TREATED IN A MELTING FURNACE

(75) Inventor: Terence D. La Sorda, Norristown, PA (US)

(73) Assignee: Air Liquide Industrial U.S. LP, Houston, TX (US)

( * ) Notice: Subject to any disclaimer, the term of this patent is extended or adjusted under 35 U.S.C. 154(b) by 726 days.

This patent is subject to a terminal disclaimer.

(21) Appl. No.: 12/536,521

(22) Filed: Aug. 6, 2009

(65) Prior Publication Data

US 2009/0288520 A1 Nov. 26, 2009

Related U.S. Application Data

(62) Division of application No. 11/829,115, filed on Jul. 27, 2007, now abandoned.

(60) Provisional application No. 60/839,776, filed on Aug. 23, 2006.

(51) Int. Cl.
*B22D 21/02* (2006.01)

(52) U.S. Cl.
USPC ..... 266/217; 266/265

(58) Field of Classification Search
USPC ..... 266/217, 44, 265
See application file for complete search history.

(56) References Cited

U.S. PATENT DOCUMENTS

| | | | |
|---|---|---|---|
| 3,400,752 | A | 9/1968 | Unsworth |
| 3,443,806 | A | 5/1969 | Galey et al. |
| 3,484,232 | A | 12/1969 | Karinthi et al. |

(Continued)

FOREIGN PATENT DOCUMENTS

| | | |
|---|---|---|
| CA | 969323 | 6/1975 |
| CA | 973366 | 8/1975 |

(Continued)

OTHER PUBLICATIONS

Till, K., et al., "The Induction Melting of Stainless Steel Under the Protection Of Liquid Argon for Powder Metal Manufacture," Metal Powder Industries Federation, Conference: Advances In Powder Metallurgy and Particulate Materials, 1994, vol. 1, Power Manufacturing and Industry Trends.

(Continued)

*Primary Examiner* — Scott Kastler
(74) *Attorney, Agent, or Firm* — Elwood L. Haynes; Allen E. White

(57) ABSTRACT

Systems and corresponding methods are described herein that provide an effective inert blanket over a metal surface (hot solid (charge) metal or molten metal) in a container such as an induction furnace. The system includes a container of metal and a system configured to delivery biphasic inert cryogen toward the metal. The delivery system may include a lance disposed at the top of the container. The lance has a hood that directs both a flow of liquid cryogen and a flow of vaporous gas toward the metal surface. The liquid cryogen contacts the metal surface, generating a volume of expanding gas over the metal surface. The vaporous cryogen creates a reinforcing vapor that slows the expansion rate of the expanding gas, localizing the expanding gas over the metal surface.

9 Claims, 2 Drawing Sheets

(56) References Cited

U.S. PATENT DOCUMENTS

| | | | |
|---|---|---|---|
| 3,598,168 | A | 8/1971 | Clark |
| 3,619,172 | A | 11/1971 | Lutgen et al. |
| 3,640,702 | A | 2/1972 | Karinthi et al. |
| 3,664,652 | A | 5/1972 | Spire et al. |
| 3,689,048 | A | 9/1972 | Foulard et al. |
| 3,743,500 | A | 7/1973 | Foulard et al. |
| 3,868,987 | A | 3/1975 | Galey et al. |
| 4,059,424 | A | 11/1977 | Bentz |
| 4,087,899 | A | 5/1978 | Chevalier et al. |
| 4,089,678 | A | 5/1978 | Hanawalt |
| 4,093,553 | A | 6/1978 | Galey et al. |
| 4,178,980 | A | 12/1979 | Gilbert et al. |
| 4,181,522 | A | 1/1980 | Galey et al. |
| 4,211,269 | A | 7/1980 | Bentz et al. |
| 4,236,913 | A | 12/1980 | Austin |
| 4,460,409 | A | 7/1984 | Devalois et al. |
| 4,519,438 | A | 5/1985 | Grosso et al. |
| 4,549,598 | A | 10/1985 | Gervais et al. |
| 4,565,234 | A | 1/1986 | Rimbert |
| 4,614,216 | A | 9/1986 | Savard et al. |
| 4,657,587 | A | 4/1987 | Savard et al. |
| 4,791,977 | A | 12/1988 | Chandley |
| 4,806,156 | A | 2/1989 | Anderson et al. |
| 4,828,609 | A | 5/1989 | Anderson et al. |
| 4,848,751 | A | 7/1989 | Lutgen et al. |
| 4,962,291 | A | 10/1990 | Fujita et al. |
| 4,990,183 | A | 2/1991 | Anderson et al. |
| 5,404,929 | A | 4/1995 | Till |
| 6,228,187 | B1 | 5/2001 | Till |
| 6,491,863 | B2 * | 12/2002 | Jepson ..... 266/46 |
| 6,508,976 | B2 | 1/2003 | Till |
| 2002/0070488 | A1 | 6/2002 | Jepson |

FOREIGN PATENT DOCUMENTS

| | | | |
|---|---|---|---|
| EP | 0089282 | | 9/1983 |
| EP | 0300907 | | 1/1989 |
| EP | 0387107 | | 9/1990 |
| EP | 0715142 | | 6/1996 |
| GB | 220279 | | 2/1925 |
| GB | 987190 | | 3/1965 |
| GB | 1372801 | | 11/1974 |
| GB | 2092037 | | 8/1982 |
| JP | 57-150784 | A | 9/1982 |
| JP | 58020369 | | 2/1983 |
| JP | 5211926 | | 8/1993 |
| JP | 07-224332 | A | 8/1995 |
| JP | 8103953 | | 4/1996 |
| JP | 10-002675 | A | 1/1998 |
| JP | 2004-068139 | A | 3/2004 |
| WO | WO 8000137 | | 2/1980 |

OTHER PUBLICATIONS

Barber, R.E., et al., "Franklin Bronze Achieves Dramatic Results in SPAL Application Tests," INCAST, vol. 15, No. 5, 2002, pp. 16-17.
Search Report PCT/IB2007/002353.

* cited by examiner

VAPOR-REINFORCED EXPANDING VOLUME OF GAS TO MINIMIZE THE CONTAMINATION OF PRODUCTS TREATED IN A MELTING FURNACE

CROSS REFERENCE TO RELATED APPLICATIONS

The present application is a divisional of U.S. patent application Ser. No. 11/829,115 filed Jul. 27, 2007 now abandoned which claims priority to U.S. Provisional Patent Application Ser. No. 60/839,776 filed Aug. 23, 2006.

BACKGROUND

1. Field

This invention relates to the minimizing of contamination of molten metal during processing.

2. Related Art

In the metal casting industry, metals (ferrous or non-ferrous) are melted in a furnace, and then poured into molds to solidify into castings. In the foundry melting operations, metals are commonly melted in electric induction furnaces. It is often advantageous to melt and transport the metals without exposure to atmospheric air to minimize oxidation of the metal (including its alloying components), which not only increases yield and alloy recovery efficiency, but also reduces formation of metallic oxides, which can cause casting defects (inclusions), reducing the quality of the finished product. Molten metal, moreover, has a tendency to absorb gases (chiefly oxygen and hydrogen) from the atmosphere (ambient air), which cause gas-related casting defects such as porosity.

Various processes are utilized to prevent exposure of the metal to the atmospheric air, including vacuum treatment and inerting with a gas or a liquid. In vacuum treatment, a fluid-tight furnace chamber is vacuum evacuated of substantially all ambient oxygen prior to heating the metal. This process, however, requires a special vacuum furnace and is generally only suitable for small batch processes. In addition, the use of a vacuum furnace also results in the need for a substantially long cooling period, which lowers plant productivity.

With gas inerting, a continuous flow of inert gas is injected into the furnace chamber. This creates a blanket of inert gas that purges ambient oxygen from the chamber, as well as prevents the ambient air from entering the chamber. This process, however, requires an extraordinarily large volume of gas to be used during the process, even with a substantially fluid-tight chamber. The process, moreover, fails to keep the concentration of residual oxygen low enough to prevent the formation of an oxide layer on most metal products. Hot thermal updrafts from within the hot furnace are continually pushing the incoming cold inert gas up and away from the metal surface. Thus, as the hot air and gases rise, the induced draft continually pulls fresh cold air toward the furnace. The injected inert gas will also entrain ambient air along with it as it is injected into the furnace. Because of these effects, it is difficult, if not impossible, for gas inerting techniques to provide a true inert (0% $O_2$) atmosphere directly at the surface of the metal.

With liquid inerting, a liquid cryogen (typically $N_2$ or Ar) covers the entire exposed surface of the metal (i.e., hot solid metal or molten metal). Since the liquid cryogen has higher density than its gas phase and air, it is much less likely to be pushed up and away from the melt surface by the thermal updrafts. After contacting the metal surface, within a short time, the liquid vaporizes into a gas. As the cryogen boils from liquid to gas, it expands volumetrically by a factor of about 600-900 times as it rises. As a result, the expansion pushes ambient air away from the surface of the metal, inhibiting oxidation. One drawback of liquid inerting is the difficulty of efficiently delivering the liquid cryogen to the furnace interior in a liquid state. The liquefied gas is extremely cold. In the storage tank and distribution piping, the liquid inert gas is continually absorbing heat from the surroundings, boiling some of the liquid to vapor inside the storage tank and distribution piping. This vapor must be vented before the liquid is injected into the chamber, otherwise flow sputtering and surging results (caused by the tendency of the gas to choke the flow of liquid in the delivery pipes). As a result, a significant portion of the cryogen supply is lost due to boiling.

Thus, there still remains a need in the art to achieve low residual oxygen concentrations through a purging process without losing substantial volumes of inert gases.

SUMMARY

Systems and corresponding methods are described herein that provide an effective inert blanket over a metal surface in a container such as an induction furnace, tundish, etc. The system includes a container of metal (e.g., hot solid (charge) metal or molten metal) and a system configured to deliver biphasic inert cryogen toward the metal. The delivery system may include a lance disposed proximate the top of the container. The lance includes a hood that directs both a flow of liquid cryogen and a flow of vaporous cryogen toward the metal surface. The liquid cryogen travels to the metal surface, where it vaporizes to generate a volume of expanding gas. The vaporous cryogen, moreover, is directed downward, toward the expanding gas. The vaporous cryogen reinforces expanding gas, slowing its expansion rate to maintain the expanding gas over the metal surface. Thus, the liquid and vaporous gas work in tandem to inhibit the oxidation of the metal.

The system can include a number of different features, including any one or combination of the following features:

- an open vessel for containing molten metal, the vessel including a bottom wall, a side wall, and an opening;
- an inert cryogen source, the inert cryogen including a liquid flow component and a vaporous flow component;
- a delivery system disposed proximate the opening, the delivery system comprising (1) a lance including an inlet and a outlet, the inlet connected to the inert cryogen source and/or (2) a hood coupled to the outlet end of the lance, wherein the hood directs the components of the inert cryogen toward the molten metal;
- a hood configured to direct the liquid component of the inert cryogen toward the bottom wall of the vessel such that the liquid component contacts the molten metal to form an expanding volume of gas having a rate of expansion;
- a hood further configured to direct the vaporous component toward the molten metal to inhibit the rate of expansion of the expanding volume of gas;
- a hood having a curved housing with an inlet and an outlet located downstream from the outlet;
- a hood positioned such that the outlet of the hood is generally coplanar with or below the opening of the vessel;
- a delivery system operable to generate a flow rate of inert cryogen in the range of about 0.002 $lb/in^2$ to about 0.005 $lb/in^2$, based upon the surface area of the molten metal;
- diffuser operable to separate the liquid flow component from the vaporous flow component; and
- a hood having a degree of curvature of about 0° to about 90°.

A method of providing a vapor blanket over a material processed within a container is also described herein. The method can include a number of different features, including any one or combination of the following features:

- forming molten metal within a container, the molten metal having an exposed surface defining a surface area;
- generating a biphasic inert cryogen, wherein the inert cryogen comprises a liquid flow component and a vaporous flow component;
- directing the liquid flow component into contact with the molten metal to generate an expanding gaseous volume having a rate of expansion; and
- directing the vaporous flow component into the container to inhibit the rate of expansion of the gaseous volume;
- directing a flow of biphasic inert cryogen at a flow rate effective to generate the expanding gaseous volume that is substantially coextensive with the exposed surface of the molten metal;
- determining flow rate based upon the surface area of the molten metal;
- providing a flow rate in the range of about 0.002 lb/in$^2$ to about 0.005 lb/in$^2$, based upon the surface area of the molten metal;
- providing a molten metal possessing a generally meniscoid shape with a raised center meniscus portion and a lower edge meniscus portion, and directing the liquid flow component into contact with the lower meniscoid portion;
- maintaining the flow rate to localize the liquid flow component within a portion of the molten metal exposed surface;
- providing a container including a bottom wall, a side wall, and an opening, and directing the liquid flow component proximate the side wall such that the liquid flow component contacts the molten metal at a point proximate the side wall;
- directing a liquid inert cryogen from a source through a diffuser to separate the liquid flow component from the vaporous flow component; and
- maintaining a flow rate of the inert cryogen such that liquid flow is localized within an area smaller than the molten metal exposed surface.

The above and still further objects, features and advantages of the systems and methods described herein will become apparent upon consideration of the following detailed description of specific embodiments thereof, particularly when taken in conjunction with the accompanying drawings, wherein like reference numerals designate like components.

DESCRIPTION OF PREFERRED EMBODIMENTS

The present invention provides a system and process wherein a vapor reinforced expanding volume of inert gas (e.g., argon, nitrogen, or carbon dioxide) is developed and maintained over the surface of metal (e.g., molten metal and/or heated metal charge) in a container such as a melting furnace or a transfer system (a ladle, a launder, etc.). The reinforced expanding volume of inert gas may be generated and maintained from a vaporizing volume of liquid cryogen situated against one or more sides of the inside surface of the container. The volumes of expanding gas may be maintained by a continuous stream of liquid cryogen replenishing the vaporizing volume of liquid cryogen from a lance system at the top of the furnace.

Figure 1:
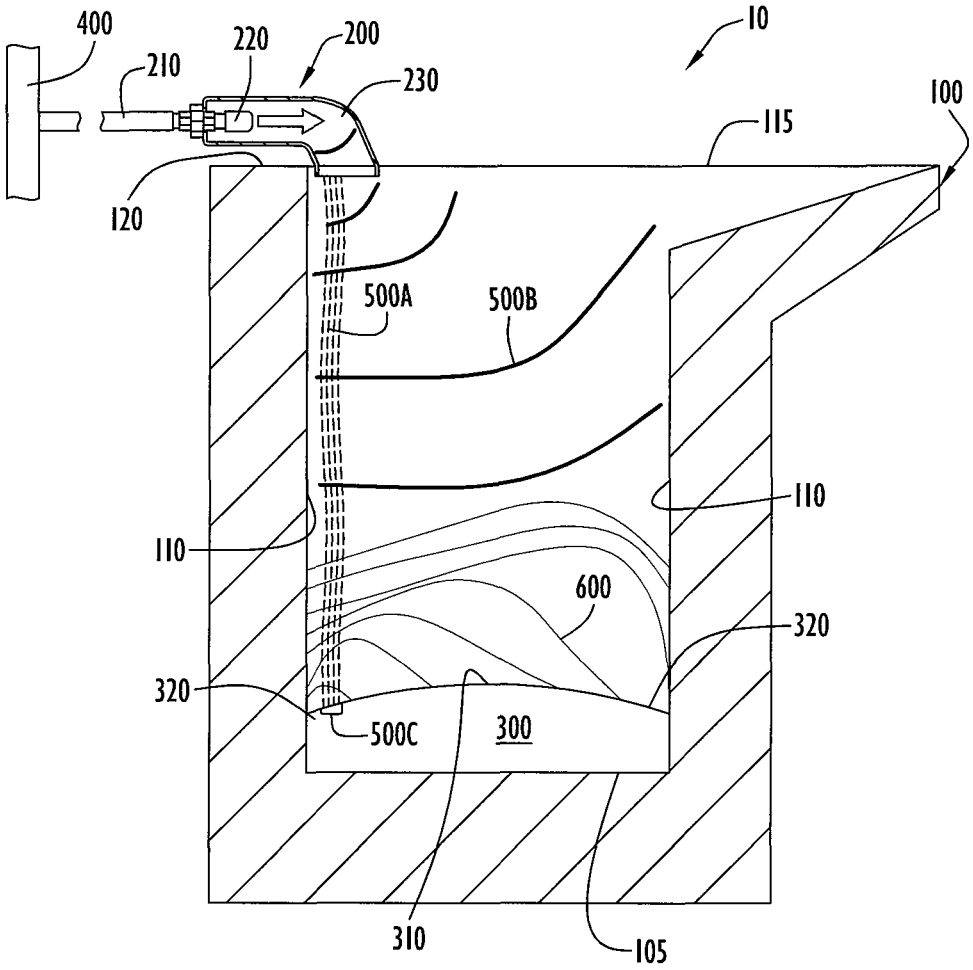
FIG. 1 depicts cross-sectional view of an exemplary embodiment of a container with a heated load of metal and a delivery system for a biphasic inert cryogen in accordance with an embodiment of the invention.

FIG. 1 shows a system 10 in accordance with an embodiment of the invention. As illustrated, the system 10 includes a container 100 and a biphasic cryogen delivery system 200. The container 100 includes a bottom wall 105, a side wall 110, and an opening 115 defined by a rim 120. The container 100 houses metal 300 (e.g., molten metal and/or heated charge material). By way of example, the container 100 may be a molten metal bath, an induction furnace, or a metal containment and/or transfer system such as a ladle, launder, etc. Convection movements and/or surface tension present in the molten metal form a converging meniscus with a raised central portion 310 and lower edge portion 320 disposed along the side wall 110 of the container 100.

The biphasic cryogen delivery system 200 distributes liquid and vaporous inert cryogen into the container 100. The system 200 may include a lance 210 disposed at the top of the container 100. The lance 210 may communicate with an inert liquid cryogen source 400 (e.g., a storage vessel). The inert liquid cryogen may include, but is not limited to, argon, nitrogen, or carbon dioxide.

As discussed above, in traveling from the source 400 to the container 100, the inert liquid cryogen absorbs heat, forming a vaporous/gaseous component. Consequently, a diffuser 220 may be coupled to the lance 210 to separate the vaporous component from the liquid component (i.e., the vaporous cryogen from the liquid cryogen). The diffuser 220 may include, for example, a sintered 10-80μ level plug disposed at the discharge end of the lance 210. The diffuser 220 is housed within a shroud or hood 230 configured to channel the liquid and gas components exiting the diffuser, directing them into the container 100. Specifically, the hood 230 is shaped to direct the biphasic flow or cryogen (i.e., the flow of liquid cryogen 500A and the flow of vaporous cryogen 500B) toward the surface of the metal 300.

Figure 2:
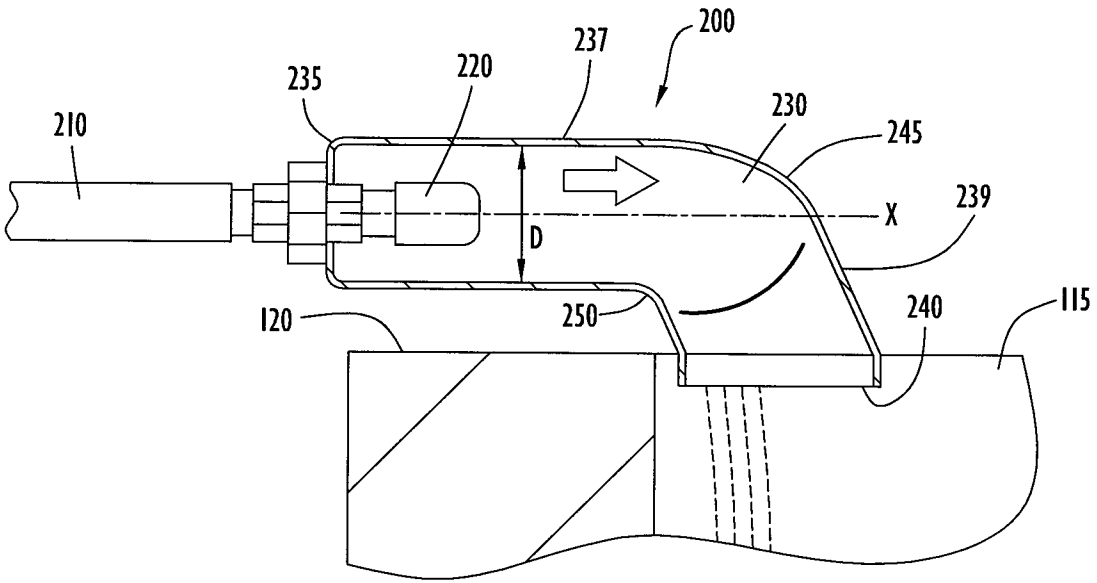
FIG. 2 is a close-up view of the delivery system shown in FIG. 1.

FIG. 2 illustrates a close-up view of the hood 230 illustrated in FIG. 1. In the embodiment illustrated, the hood 230 includes an inlet end 235, a first portion 237, a second portion 239, and an outlet end 240. The hood 230 curves downward, away from the longitudinal axis of the hood (indicated by X), creating a first or outer bend 245 and a second or inner bend 250. The degree of curvature may include, but is not limited to, downward curvatures in the range of about 0° (where the outlet 240 is generally perpendicular to the axis X) to about 90° (wherein the outlet 240 is generally parallel to the axis X). The dimensions of the hood may be any suitable for its described purpose. By way of example, the hood 230 may have an overall length of approximately 4-6 inches (10.16 cm-15.24 cm). By way of specific example, the first portion 237 (extending from the inlet 235 to the bend 245/250) may be about 3-5 inches (7.62 cm-12.7 cm) (e.g., 4 inches (10.16 cm)), while the second portion (extending from the bend 245/250 to the outlet 240) may be about 0.5-3 inches (1.27 cm-7.62 cm) (e.g., about 1.5 inches (3.81 cm)). The diameter of the hood channel (indicated as D) may be about 0.5 inches to 2 inches (1.27 cm-5.08 cm) (e.g., 1 inch (3.54 cm)). Preferably, the diameter D of the channel is substantially continuous from the inlet 235 to the outlet 240. The material forming the hood includes, but is not limited to, stainless steel tubing.

The hood 230 is disposed oriented to introduce the liquid cryogen 500A and vaporous cryogen 500B into the container.

For example, the hood 230 may be disposed at a point proximate the opening 115 of the container 100. By way of specific example, the outlet end 240 may be generally coplanar with the opening 115 of the container 100, or may be positioned slightly below the opening 115 such that it protrudes into the container interior. The hood 230, moreover, may be oriented on the container such that the inner bend 250 of the hood is positioned adjacent the sidewall 110.

With this configuration, the liquid cryogen 500A is directed along/adjacent the side wall 110 of the container 100, permitting the liquid cryogen to reach the metal 300 and create a localized pool or volume 500C of liquid cryogen along the lower meniscus portion 320. This is contrary to conventional liquid cryogen delivery systems, which direct a blanket of liquid over the entire metal surface. Instead, the delivery system 200 of the present invention controls parameters to cause the liquid cryogen 500A to become localized on the metal 300. That is, the liquid cryogen 500A covers only a portion of the metal surface, localizing the liquid cryogen within an area generally adjacent the side wall 110 of the container 100.

As noted above, the pool 500C of liquid cryogen is formed proximate the side wall 110 of the container. It is more effective to deliver the liquid cryogen 500A down the side wall 110 of the container (to the lower portion 320 of the meniscus) to maximize the cryogen delivered to the meniscus site, as well as to create a pool 500C of liquid cryogen at the lowest elevation within the metal environment (e.g., the lowest level of a furnace). In contrast, delivering the liquid cryogen 500A to the upper portion 310 of the meniscus would inhibit the amount of cryogen actually delivered to the lower portion 320 of the meniscus (along the side wall 110) because the cryogen 500C would become trapped within or above the charge material (solid charge that will melt during the heat cycle). Also, placing the delivery system 200 along the side wall 110 of the container 100 (e.g., perpendicular to and adjacent the pouring spout of a furnace) provides an additional benefit of automatically facilitating inert protection of the pour of the metal into the transfer ladle, launder, tundish mold, etc.

Thus, with the above hood configuration, the flow of liquid cryogen 500A forms a small volume 500C of liquid cryogen on the surface of the metal 300, adjacent the side wall 110. Due to the heat generated by the surface of the molten metal 300, as well as the heat radiated by the furnace walls 110, the pool of liquid cryogen 500C vaporizes, generating an expanding volume of inert gas 600 that expands across the entire exposed surface of the metal 300. This expansion pushes ambient air away from the surface of the metal 300, and infiltrates any charge material melting at the molten surface. This, in turn, provides a true inert atmosphere directly at the metal surface. The expansion rate of the gas 600 is generally dependant upon the type of inert gas utilized in forming the inert blanket (e.g., argon, nitrogen, or carbon dioxide). By way of example, as the pool 500C of liquid cryogen boils from liquid to gas, it may expand volumetrically by a factor of about 600-900 times as it rises. By way of specific example, argon expands up to 840 times the liquid volume while heating up from −302° F. (−185° C.) to room temperature.

The faster the expanding gas 600 expands, the quicker it escapes the container 100, becoming lost into the surrounding environment. Such a loss not only reduces the effectiveness of the inert blanket, but also alters the surrounding atmosphere (e.g., exposing users to inert gas). To minimize and/or eliminate the rate of loss of the expanding volume of gas 600 from the container 100, the delivery system 200 further directs a shroud of vaporous cryogen 500B into the container, where it reinforces the expanding volume of inert gas 600 generated from the pool 500C of cryogenic liquid, maintaining the expanding volume 600 proximate the exposed metal surface. Specifically, the hood 230 directs the vaporous cryogen 500B toward the expanding gas 600, reinforcing the expanding gas and inhibiting its rate of expansion and diffusion into the atmosphere above the container 100. This alleviates a major drawback of conventional liquid inerting (discussed above), where a large portion of the inert cryogen is lost (e.g., when vented off to avoid lance sputtering).

The flow rate of the biphasic cryogen 500A, 500B from the source 400 should be effective to provide a continuous volume of expanding inert gas 600, to maintain a localized pool 500C of liquid cryogen on the surface of the metal 300 (i.e., to prevent the liquid cryogen 500A from creating a pool 500C that covers the entire surface of the metal 300), and to maintain the flow reinforcing vaporous cryogen 500B toward the metal surface. Preferably, the flow rate is determined as a function of the surface area of the metal 300. This is contrary to the prior art processes, which calculate the flow rate utilizing the volume of the metal. Preferably, the continuous stream of cryogen is maintained at a flow rate of about 0.002 lb/in$^2$ to about 0.005 lb/in$^2$ (about 0.14 g/cm$^2$ to about 0.35 g/cm$^2$) of the exposed metal surface area in the container 100. This maintains a flow of cryogen at a rate effective to generate a beneficial amount vaporous cryogen 500B capable of reinforcing the expanding gas 600. For example, the ratio of liquid cryogen 500A to vaporous cryogen 500B exiting the lance 210 may be about 99/1 to about 51/49, depending on the thermal quality of the cryogen distribution system and the working pressure of the cryogen supply tank. Flow rates above the preferred range tend to increase process costs, as well as lead to the "popping" of the metal 300 out of the container 100 due to volumetric and mechanical expansion of the cryogen 500C as it transitions from a liquid to a vapor. This creates a hazardous situation for users in the area around the container 100.

In operation, the hood 230 directs the liquid cryogen 500A into the container 100, causing the liquid cryogen to fall from the lance 210 adjacent to the side wall 110 and form the small volume (pool 500C) of liquid cryogen on the surface of the metal 300, adjacent the side wall of the container 100. The liquid volume 500C vaporizes, creating an expanding gas 600 that expands across the entire surface of the metal 300. At the same time, the hood 230 directs the vaporous gas 500C downward, toward the metal surface, inhibiting the expansion of the expanding gas 600, maintaining the reinforced vapor near the surface of the metal 300.

Conventional processes use either already expanded inert gas or an inert cryogenic liquid as a protective barrier for the molten metal and/or charge material in the container. The vapor reinforced expanding gas approach to inert blanketing is distinguished from such conventional processes in that it offers a higher level of safety for the furnace operator, an increased consistency and effect of the inert blanket, and an increase in inert gas efficiency or lower application cost. It delivers the entire inert product from the source 400 through the delivery system 200 to the internal atmosphere of the container 100 at a point above the melt interface.

This above-describe system is effective to guide the vaporous cryogen 500B into the container 100, providing for the complete utilization of the vaporous cryogen, using it to reinforce the expanding gas 600. In conventional systems, a 3-15% of the inert cryogen is wasted of the tip of a lance due to flash losses. The present system avoids these losses by completely utilizing the vaporous cryogen 500B, directing it into the container 100 in a manner (at a speed and in an amount) effective to minimize and/or avoid flash losses.

While the invention has been described in detail and with reference to specific embodiments thereof, it will be apparent to one skilled in the art that various changes and modifications can be made therein without departing from the spirit and scope thereof. For example, the hood 230 may possess any dimensions and shape suitable for its described purpose (directing a biphasic flow into the container), and may be modified based on factors such as manufacturing cost, manufacturing method, and application site parameters. In addition, while the flow rate is dependent primarily upon the surface area of the metal 300 in the container 100 requiring protection by the expanding gas 600, secondary factors may be used to determine the flow rate of the liquid cryogen, such as the reactivity of the alloy or metal being protected, the existence and strength of the ventilation system, and the quality requirements of the end user for the metal being produced. Furthermore, while a single source 400 of inert cryogen is illustrated, it is understood that multiple sources 400 may be connected to lance 210 to provide multiple types of inert cryogen to the container, including mixtures.

In addition, the systems and methods described can include any one or more suitable controllers and/or sensors to facilitate monitoring and control of various operational parameters during heating of the load in the furnace. One or more suitable sensors and related equipment can also be provided to measure and monitor the concentration of the gaseous species within the furnace, preferably at locations in the immediate vicinity of the load surface. Also, when the container 100 is an induction furnace, the induction furnace can include any suitable number and different types of sensors to monitor one or more of the temperature, pressure, flow rate and concentration of nitrogen and/or any other gaseous species within the furnace.

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration. Thus, it is intended that the present invention covers the modifications and variations of this invention provided they come within the scope of the appended claims and their equivalents.

The invention claimed is:

1. A heating system comprising:

a open vessel for containing molten metal, the vessel including a bottom wall, a side wall, and an opening;

an inert cryogen source, the inert cryogen including a liquid flow component and a vaporous flow component;

a delivery system disposed proximate the opening, the delivery system comprising:

a lance including an inlet and a outlet, wherein the inlet is connected to the inert cryogen source;

a hood coupled to the outlet of the lance, wherein the hood directs the components of the inert cryogen toward the molten metal, wherein the hood is configured to direct the liquid component of the inert cryogen toward the bottom wall of the vessel such that the liquid component contacts the molten metal to form an expanding volume of gas having a rate of expansion, and wherein the hood is further configured to direct the vaporous component toward the molten metal to inhibit the rate of expansion of the expanding volume of gas and wherein the hood is oriented proximate to the side wall of the vessel such that the hood is configured to be capable directing a flow of liquid cryogen to form a localized pool of liquid cryogen on a surface of a molten metal adjacent to the vessel side wall.

2. The heating system of claim 1, wherein the hood comprises a curved housing including an inlet and an outlet located downstream from the inlet.

3. The heating system of claim 2, wherein the hood possesses a degree of curvature of about 0° to about 90°.

4. The heating system of claim 1, wherein the hood comprises an outlet oriented such that it is generally coplanar with the opening of the vessel.

5. The heating system of claim 1, wherein the hood comprises outlet oriented within the vessel at a point slightly below the opening of the vessel.

6. The heating system of claim 1, wherein the delivery system is capable of generating a flow rate of inert cryogen the range of about 0.002 $lb/in^2$ to about 0.005 $lb/in^2$, wherein the $in^2$ is the surface area of the molten metal.

7. The heating system of claim 1, wherein the delivery system further comprises a diffuser disposed at the outlet of the lance and housed within the hood, the diffuser operable to separate the liquid flow component from the vaporous flow component.

8. The heating system of claim 1, wherein:

the hood comprises a curved housing including an inlet and an outlet located downstream from the inlet;

the outlet of the hood is either generally coplanar with the opening of the vessel or disposed below the opening of the vessel; and the delivery system is capable of generating a flow rate of inert cryogen in a range of about 0.002 $lb/in^2$ to about 0.005 $lb/in^2$, wherein the $in^2$ is the total surface area of the molten metal.

9. The heating system of claim 8, wherein the outlet of the hood is oriented proximate the side wall of the vessel.

* * * * *